United States Patent [19]

Moriano et al.

[11] Patent Number: 4,734,832

[45] Date of Patent: Mar. 29, 1988

[54] SPOTLIGHT WITH INTERCHANGEABLE HANDLE

[75] Inventors: Roger A. Moriano, San Mateo; Ralph F. Osterhout, San Francisco, both of Calif.

[73] Assignee: Tekna, Belmont, Calif.

[21] Appl. No.: 868,238

[22] Filed: May 23, 1986

[51] Int. Cl.[4] ..... F21L 11/00; F21V 31/02

[52] U.S. Cl. ..... 362/158; 362/399; 362/190; 335/205

[58] Field of Search ..... 362/157, 158, 190, 109, 362/368, 394, 399, 208, 267; 335/205, 207

[56] References Cited

U.S. PATENT DOCUMENTS

| | | | |
|---|---|---|---|
| 2,716,184 | 8/1955 | O'Neil | 362/394 |
| 3,001,185 | 9/1961 | Cleek | 362/157 |
| 3,229,084 | 1/1966 | Bates | 362/158 |
| 3,398,271 | 8/1968 | Sakamoto | 362/158 |
| 3,790,912 | 2/1974 | Murphy | 335/205 |
| 3,794,825 | 2/1974 | Krupansky | 362/158 |
| 3,810,052 | 5/1974 | Yanaga | 335/205 |
| 4,233,655 | 11/1980 | Zelina, Jr. et al. | 362/399 |
| 4,346,360 | 8/1982 | Del Tufo | 335/205 |
| 4,535,397 | 8/1985 | May | 362/109 |

FOREIGN PATENT DOCUMENTS

| | | | |
|---|---|---|---|
| 1098378 | 1/1968 | United Kingdom | 335/205 |

*Primary Examiner*—E. Rollins Cross
*Assistant Examiner*—D. M. Cox
*Attorney, Agent, or Firm*—Townsend & Townsend

[57] ABSTRACT

A hand held spotlight includes a sealed beam enclosure together with one or more detachable handles. The detachable handles each include a latching mechanism capable of translating a magnet between a first position and a second position. A magnetically-actuated switch within the enclosure is used to turn off and on the light circuit. The handle is detachably mounted on the enclosure in a particular position so that the magnetically-actuated switch within the enclosure may be opened and closed by the magnet in the handle. In the preferred embodiments, a single enclosure may be utilized with either a pistol-style grip or a lantern-style grip. The ability to form the beam enclosure without penetrations is particularly useful in providing watertight and explosion-proof spotlights.

8 Claims, 11 Drawing Figures

SPOTLIGHT WITH INTERCHANGEABLE HANDLE

BACKGROUND OF THE INVENTION

1. Field of the Invention

The present invention relates generally to sealed electronic devices having external mechanisms for actuating internal switches, and more particularly to a watertight spotlight having one or more detachable handles, where each of the handles includes a mechanism for actuating a switch internal to the spotlight enclosure.

The ability to completely seal the electronic components of an electronic device within a single enclosure is desirable for many reasons. For example, in the case of a spotlight or flashlight, providing a sealed beam enclosure is desirable since the flashlight may then be used under water, will be explosion-proof, and will be protected from harsh, corrosive atmospheres.

The ability to completely seal a hand held spotlight is complicated by the need to provide an external switch or other means for turning the light off and on. Normally, the external switch will penetrate the beam enclosure, potentially breaking the seal of the beam. While various approaches are available for sealing the switch, such as placement of a flexible membrane over the switch, providing sealing rings and gaskets, and the like, the presence of an aperture in the enclosure is a potential failure point.

With the present invention, the difficulty in providing a suitably sealed switch is rendered more difficult by the desire to provide detachable, interchangeable handles on a common beam enclosure. It is further desired that each of the handles include a manually actuated button or lever for actuating an internal switching mechanism within the enclosure.

It is therefore desirable to provide a switch assembly which allows the use of such detachable handles on sealed beam enclosures, where the handles include a portion of the switch assembly capable of actuating the remainder of the switch assembly inside the beam enclosure without the necessity of penetrating the beam enclosure.

2. Description of the Background Art

U.S. Pat. No. 3,790,912 discloses a flashlight having a reed switch mounted next to a slidable magnet. The flashlight enclosure, however, includes a penetration, and the patent does not disclose the concept of interchangeable handles. U.S. Pat. No. 3,810,052 discloses a single switch housing incorporating a slidable bar magnet mounted adjacent a reed switch. U.S. Pat. No. 4,346,360 describes a keyboard switch comprising a depressable bar magnet located next to a reed switch. U.S. Pat. No. 4,233,655 discloses a spotlight having a permanently fixed pistol-style grip.

SUMMARY OF THE INVENTION

In its broadest aspect, the present invention provides an apparatus comprising a detachable handle and an enclosure including external means for coupling the handle. The handle includes a mechanism for moving a magnet between a first position and a second position, while the enclosure includes an internal magnetic switch located near the coupling means so that the switch is actuated as the magnet moves from the first to the second position. The switch, in turn, is electrically connected to a circuit, typically a light circuit. Usually, the apparatus will include two or more handles having different configurations, but each including a mechanism for moving a magnet between the first position and the second position. In this way, the enclosure may be completely sealed and free from penetrations, while a variety of handles may be detachably mounted on the enclosure.

DESCRIPTION OF THE PREFERRED EMBODIMENTS

Figure 1:
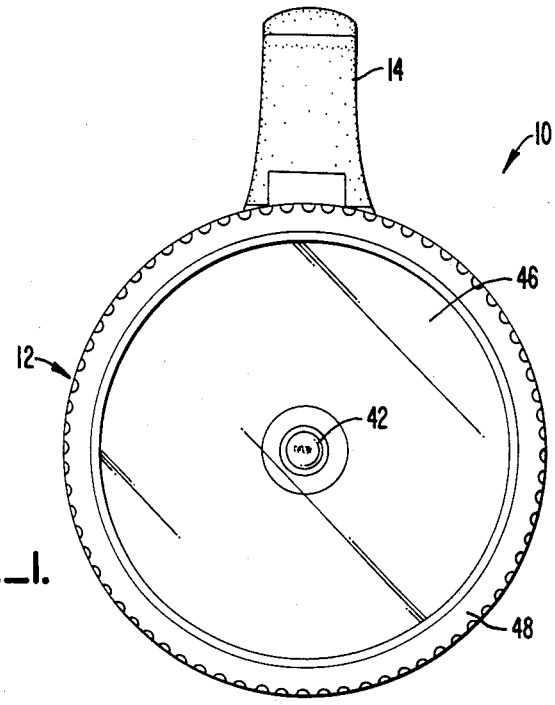
FIG. 1. is a front elevational view of a hand-held spotlight according to the present invention.
Figure 2:
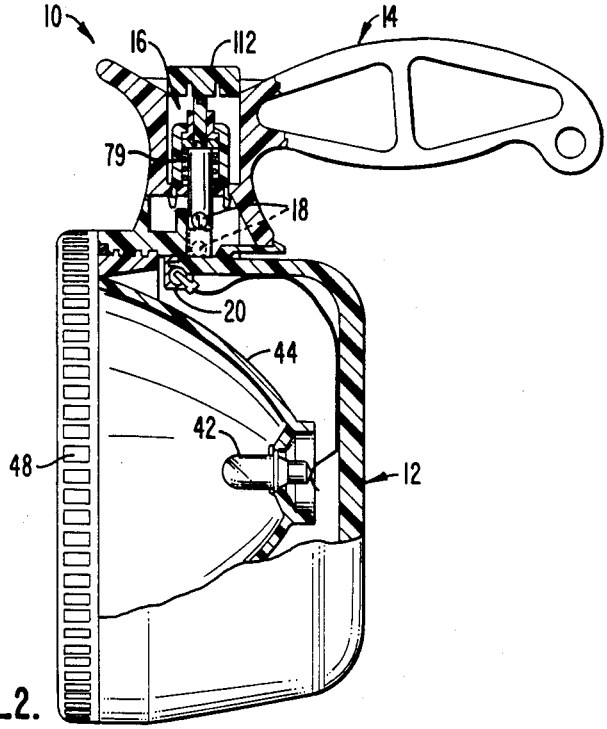
FIG. 2 is a side elevational view of the spotlight of FIG. 1, with portions broken away.

Referring now to FIGS. 1 and 2, a hand-held spotlight constructed in accordance with the principles of the present invention will be described. The spotlight 10 includes a beam enclosure 12 and a handle 14 which is detachable from the beam enclosure. Handle 14 is a lantern-style grip which includes a manually-actuated latching mechanism 16 capable of holding a magnet 18 in a first position (shown in full line in FIG. 2) and a second position (shown in broken line in FIG. 2). The magnet 18 of the latching mechanism 16 interacts with a magnetically-actuated switch 20 which is mounted internally to the beam enclosure 12. The magnetically-actuated switch is located sufficiently close to the magnet 18 (when the handle 14 is properly mounted on the enclosure 12) so that when the magnet 18 is in its extended (broken line) position, the switch 20 is closed to complete the lighting circuit, as will be described in greater detail hereinafter.

Figure 3:
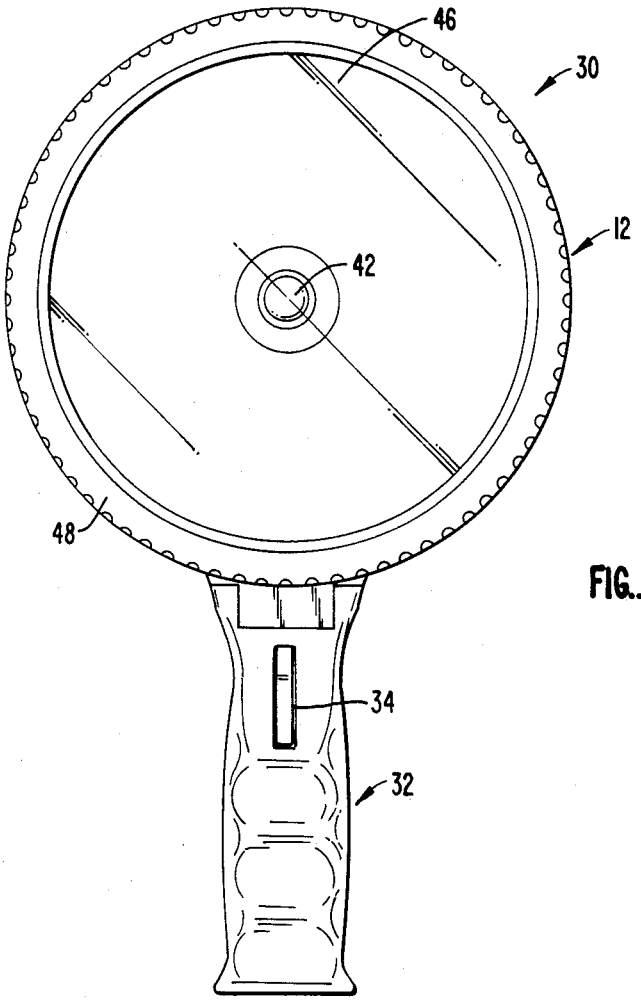
FIG. 3 is a front elevational view of an alternative embodiment of the spotlight of the present invention.
Figure 4:
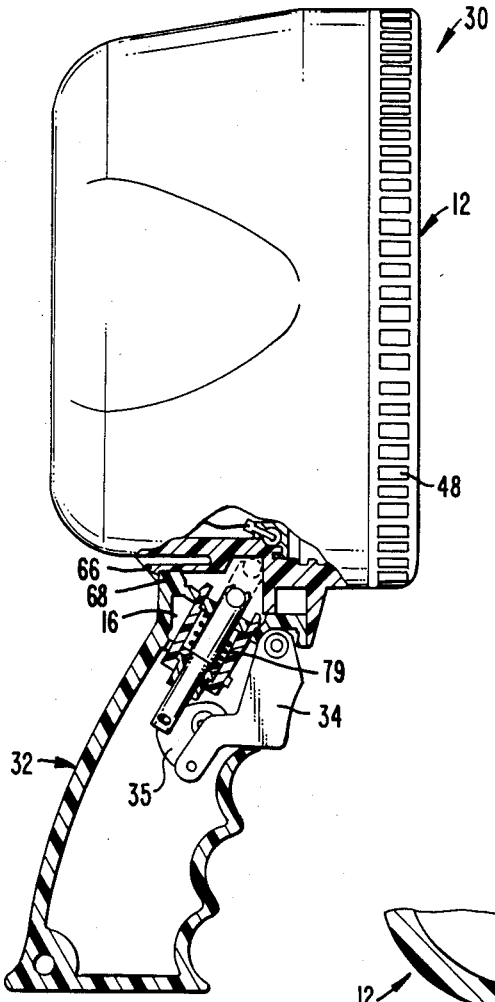
FIG. 4 is a side elevational view of the spotlight of FIG. 3, with portions broken away.

Referring now to FIGS. 3 and 4, a second spotlight 30 constructed in accordance with the principles of the present invention is illustrated. Spotlight 30 also comprises a beam enclosure 12 (which may be identical to the beam enclosure 12 of FIGS. 1 and 2) and a handle 32. Handle 32 is a pistol-type grip intended to allow the user to hold the spotlight 30 upwardly in the users hand and to direct the beam therefrom generally as one would a handgun. The spotlight 30 is actuated by a trigger 34 which is connected to latching mechanism 16, which may be identical to the mechanism 16 of spotlight 10.

Although primarily useful as hand-held spotlights, devices constructed in accordance with the principles of the present invention may also find use with other hand-held instruments where it is desirable to provide the working components of the instrument within a sealed enclosure and to attach one or more detachable handles having integral switching mechanisms capable of actuating the internal components in the enclosure. Examples of such instruments would include cameras, particularly submersible cameras, microphones, and audio recording equipment, and the like.

Figure 5:
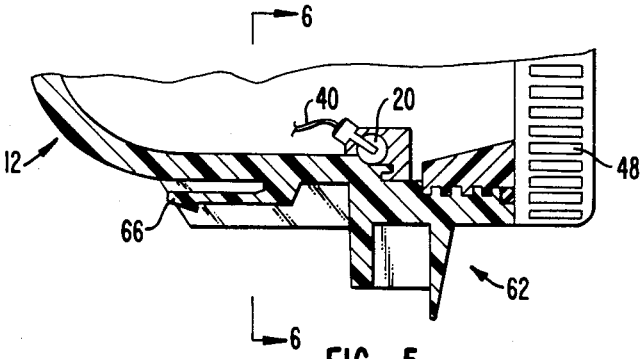
FIG. 5 is a detailed, sectional view of the beam enclosure of the spotlight of the present invention
Figure 6:
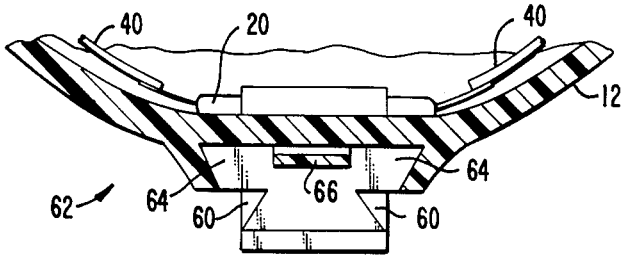
FIG. 6 is a sectional view taken along line 6—6 of FIG. 5.

Referring now in particular to FIGS. 2, 5, and 6, the beam enclosure 12 of the present invention will be described in more detail. The magnetically-will actuated switch 20, typically a magnetic reed switch, is attached to wires 40, which in turn are connected to batteries (not shown) and through a circuit to lightbulb 42. The bulb 42, in turn, is mounted in a parabolic reflector 44, and the resulting beam is projected through a front lens 46 (FIG. 1) which is protected by a bezel 48. A sealing member, such as an O-ring (not shown), is provided between the lens 46 and the remainder of the enclosure 12, so that when the lens 46 and bezel 48 are threaded onto the enclosure 12, the enclosure is watertight to a preselected depth, typically at least 200 feet. As there are no other penetrations in the enclosure, the enclosure is thus substantially sealed against the incursion of water, and is also explosion proof since explosive gases are unable to enter the enclosure.

Figure 7:
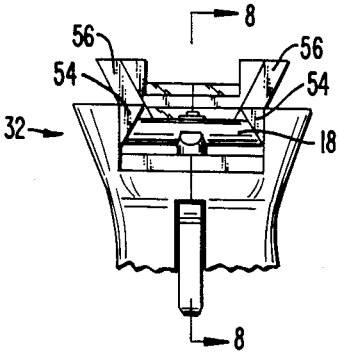
FIG. 7 is a detailed elevational view of a portion of the pistol grip of FIGS. 3 and 4.
Figure 8:
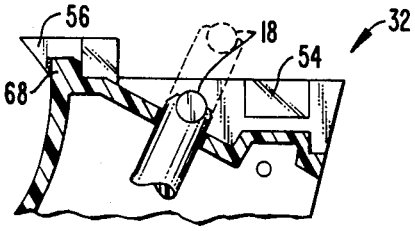
FIG. 8 is a sectional view taken along line 8—8 of FIG. 7.

Referring now to FIGS. 4, 7, and 8, a coupling mechanism for mounting the pistol style grip 32 onto enclosure 12 will be described. At its upper end, the pistol style grip 32 includes a pair of forward tabs 54 and a pair of rearward tabs 56. The forward tabs 54 slide into cavities 60 formed on coupling member 62 on the enclosure 12 (FIGS. 5 and 6). Similarly, rearward tabs 56 slide into cavities 64 formed on coupling member 62. When the handle 32 has been inserted fully into the coupling member 62, as illustrated in FIG. 4, a latch member 66 is secured over corner 68, as illustrated in FIG. 4.

Figure 9:
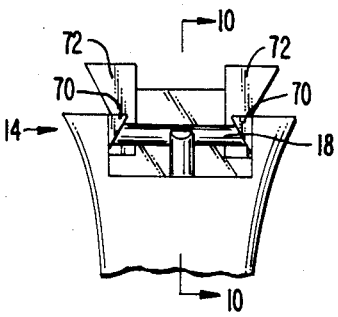
FIG. 9 is a detailed front elevational view of a portion of the lantern grip of the spotlight of FIGS. 1 and 2.
Figure 10:
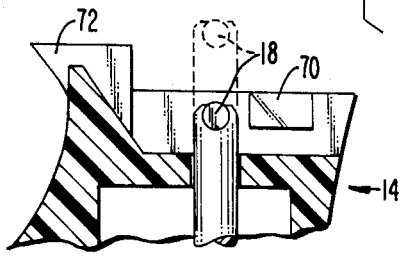
FIG. 10 is a sectional view taken along 10—10 of FIG. 9.

Referring now to FIGS. 9 and 10, the coupling end of handle 14 is arranged similarly to that of handle 32. Specifically, a pair of forward tabs 70 and rearward tabs 72 are arranged to mate with cavities 60 and 64 in the coupling member 62 of the enclosure 12. Magnet 18 is oriented slightly differently than in handle 32, but in its extended (broken line) position, it will be held sufficiently close to the magnetically actuated switch 20 in the enclosure 12 so that the switch is actuated.

Latching mechanism 16 may be constructed in substantially the same manner for both spotlights 10 and 32. Specifically, the latching mechanism 16 will include a reciprocating member 80 carrying the magnet 18 at its upper end, a rotating support ring 82, cylinder 84, and housing 86. The reciprocating member 80 is inserted into ring 82 so that shoulder 88 on member 80 is supported on an annular bearing surface 90 on ring 82.

Figure 11:
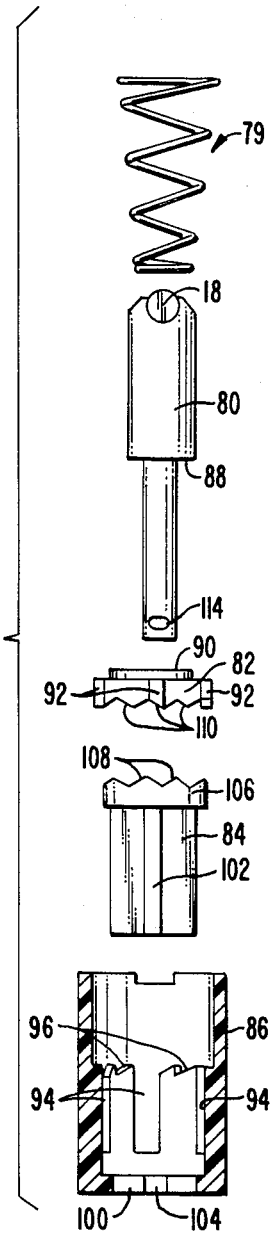
FIG. 11 is an exploded view of the latching mechanism of the handle switch for the spotlight of the present invention.

Ring 82, in turn, is supported in housing 86 in a manner that allows the ring, depending on its rotational orientation, to be supported in either an upper or a lower position (with upper and lower being defined by the directions in FIG. 11). Specifically, ring 82 includes four tabs 92, three of which are visible in FIG. 11. The tabs are dimensioned so that they may slide up and down in channels 94 defined on the interior surface of housing 86. When the tabs are aligned with the channels 94, the ring 82 is urged downward in the housing by spring 79. When the ring is rotated through a small angle, however, the tabs are no longer aligned with handles 94, and are instead supported on surfaces 96 which are spaced a fixed distance above the bottom of channels 94. This fixed distance is selected to equal the distance desired to extend magnet 18 in order to actuate magnetic switch 20.

Ring 82 is shifted between its raised and lowered positions within housing 86 by cylinder 84. Cylinder 84 is mounted to reciprocate within lower opening 100 formed in housing 86, and includes a rail 102 positioned to travel in slot 104. In this way, the cylinder 84 is prevented from rotating within the housing 86. Cylinder 84 includes a crown 106 having a plurality of inclined surfaces 108 formed about its periphery. The inclined surfaces 108, are able to mate with similar surfaces 110 on the bottom of ring 82. When the ring 82 and cylinder 84 are in housing 86, however, the ring and cylinder are rotationally misaligned so that urging the cylinder against the ring tends to rotate the ring in a first direction. So long as tabs 92 of the ring 82 are in channel 94, it is impossible to rotate the ring. As soon as the ring is raised above channels 94, however, the ring is rotated a small amount and the tabs 92 are placed on surfaces 96. The bottom of tabs 92 are inclined to mate with the inclined surfaces 96.

The reciprocatable member 80 may be returned to its retracted or lowered position by again raising the cylinder 84. The crown 106 again is urged against surfaces 110 on the ring, causing the ring to further rotate so that tabs 92 are again aligned with channels 94. The ring 82, together with the reciprocatable member 80, are then returned to the lowered or retracted position.

In the first embodiment of the spotlight, the latching mechanism 16 is actuated by a button 112 which is attached directly to hole 114 at the lower end of reciprocatable member 80. Conversely, in the second embodiment of the spotlight, the latching mechanism 16 is connected to a rotary link 35, as illustrated in FIG. 4.

Although the foregoing invention has been described in some detail by way of illustration and example for purposes of clarity of understanding, it will be obvious that certain changes and modifications may be practiced within the scope of the appended claims.

What is claimed is:

1. A lighting apparatus:

a first detachable handle including actuable means for moving a magnet between a first position and a second position; and an enclosure physically separate from the handle and including external means for coupling the handle; an internal magnetic switch located proximate the coupling means so that said switch is actuated as the magnet in the handle moves from the first to the second position; and internal means defining a circuit electrically connected to said magnetic switch, said enclosure remaining sealed when said handle is removed.

2. An apparatus as in claim 1, further comprising a second handle including actuable means for moving a magnet between a first position and a second position, said first and second handles both being capable of detachable coupling to the coupling means but having different configurations from one another.

3. an apparatus as in claim 1, wherein the circuit is a light circuit.

4. An apparatus as in claim 1, wherein the circuit includes batteries.

5. An apparatus as in claim 1, wherein the enclosure is sealable against the entry of water.

6. An electric lantern having a detachable handle, said lantern comprising:

a first handle including a manually actuated latching mechanism capable of selectively holding a magnet in a first or a second position, and a coupling member; and a beam enclosure physically separate from the handle and including an external coupling member capable of detachably mating with the coupling member on the handle, an internal magnetic switch located proximate the external coupling member so that the switch is closed when the magnet in the handle is in the first position, a battery-powered light circuit electrically connected to the switch, and reflector and lens means, said beam enclosure remaining sealed when said handle is removed.

7. An electric lantern as in claimm 6, further comprising a second detachable handle including a manually actuated latching mechanism capable of selectively holding a magnet in a first or a second position and a coupling member, said first and second handles having different configurations but each being capable of attachment to the external coupling member on the beam enclosure.

8. An electric lantern as in claim 7, wherein one of the handles is a pistol-style grip and the other is a lantern-style grip.

* * * * *